US005215047A

United States Patent [19]

Neutgens

[11] Patent Number: 5,215,047

[45] Date of Patent: Jun. 1, 1993

[54] SEAL ASSEMBLY

[75] Inventor: Kurt J. Neutgens, Canton, Mich.

[73] Assignee: Ford Motor Company, Dearborn, Mich.

[21] Appl. No.: 897,698

[22] Filed: Jun. 12, 1992

[51] Int. Cl.[5] ..... F01L 9/10

[52] U.S. Cl. ..... 123/90.37; 123/90.38; 123/196 M; 384/503; 277/101; 277/165

[58] Field of Search ..... 123/90.27, 90.33, 90.37, 123/90.38, 90.34, 196 R, 193.5, 196 M; 384/503, 138; 277/101, 128, 152, 192, 165

[56] References Cited

U.S. PATENT DOCUMENTS

| | | | |
|---|---|---|---|
| 4,151,999 | 5/1979 | Ringel et al. | 277/165 |
| 4,406,441 | 9/1983 | Lukesch et al. | 277/165 |
| 4,553,762 | 11/1985 | Hoelzer | 277/152 |
| 4,612,885 | 9/1986 | Yoshikawa | 123/90.27 |
| 4,684,267 | 8/1987 | Fetouh | 384/294 |
| 4,822,058 | 4/1989 | Butler et al. | 277/152 |
| 4,993,134 | 2/1991 | Hoag et al. | 29/888.092 |
| 5,033,422 | 7/1991 | Kurisu et al. | 123/90.27 |
| 5,052,351 | 10/1991 | Nishimura et al. | 123/90.27 |
| 5,105,538 | 4/1992 | Hoag et al. | 29/888.09 |
| 5,119,776 | 6/1992 | Bakker | 123/90.27 |
| 5,150,675 | 9/1992 | Murata | 123/90.38 |

FOREIGN PATENT DOCUMENTS

| | | | |
|---|---|---|---|
| 25711 | 3/1978 | Japan | 123/90.37 |
| 25006 | 2/1984 | Japan | 123/90.38 |
| 239303 | 10/1988 | Japan | 123/90.34 |

*Primary Examiner*—Willis R. Wolfe
*Assistant Examiner*—Weilun Lo
*Attorney, Agent, or Firm*—Roger L. May; Joseph W. Malleck

[57] ABSTRACT

A seal assembly capable of sealing a rotatable shaft protruding from a fluid-containing chamber in an internal combustion engines and the like. The seal characteristics of the seal assembly are largely attributed to surface interface between the seal cap and the main body of the seal assembly. More particularly, the seal cap includes a pair of legs each having fractured ends which are in end-to-end engagement with corresponding legs of the main body also having fractured ends. By mating corresponding fractured ends of respective legs of the seal cap and the main body, an improved seal is provided. A method by which such an improved seal assembly can be manufactured is also disclosed.

19 Claims, 2 Drawing Sheets

SEAL ASSEMBLY

BACKGROUND OF THE INVENTION

The present invention generally relates to seal assemblies, and more particularly, to an improved seal assembly for sealing a rotatable shaft protruding from a fluid-containing chamber in internal combustion engines and the like.

As is well known in the mechanical arts, seal assemblies can be used in a wide variety of structural and machine components having a part protruding from a fluid-containing chamber. For example, seal assemblies can be used in sealing rotatable shafts in internal combustion engines. Most commonly, this application entails sealing the camshaft, which is enclosed in the oil-containing head of the internal combustion engine, such that the camshaft can protrude from the head to, for example, engaging with the timing belt of an internal combustion engine. While such a seal assembly may take a variety of structural configurations, the typical seal assembly used for these purposes will include a removable saddle-shaped seal cap secured to a mating saddle-shaped main body so as to define an opening through which the rotatable shaft is mounted. Thus, the seal carrier provides for the installation and removal of a rotatable shaft, such as a camshaft in an internal combustion engine.

The most common method by which such seal assemblies are formed is to form the seal cap and corresponding main body separately by casting, forging or other similar techniques and thereafter, bolting or otherwise securing together the seal cap and the main body. In many instances, finish machining of the opening through which the rotatable shaft is mounted is completed after the initial assembly of these components. This manufacturing method requires numerous machining operations, as well as preliminary assembly and disassembly of the components prior to installation of the rotatable shaft, all of which significantly increase the manufacturing costs of the internal combustion engine.

Another method by which past seal assemblies have been produced involves forming the seal cap and the main body integrally and thereafter, separating these components by sawing or otherwise cutting away excess material provided to initially join the components. After separation of the seal cap and the main body, the connecting surfaces thereof must be machined which is very time-consuming and possesses limited tolerances. In that regard, the limited tolerances result in an imperfect match upon reconnection of the main body and the seal cap. As a result, oil may seep through such imperfections between the connected surfaces of the seal cap and the main body, thereby leading to degradation of the components in the internal engine within which the seal carrier is mounted. While the use of gaskets and/or additional machining have been used to minimize this problem, such techniques increase manufacturing time and costs and do not significantly minimize fluid leakage. Therefore, there is a need in the art for an improved seal assembly which effectively seals fluids, such as oil, in internal combustion engines without significantly adding to manufacturing costs.

While a few attempts in the art of split bearings have been made to facilitate alignment of bearings by using fracture techniques along fracture planes resulting in interlocking or mating rough surfaces that are capable of being reengaged, none of these attempts employ their fracture techniques in the art of seal assemblies for purposes of preventing fluid leaks, especially in internal combustion engines. For example, Fetouh, U.S. Pat. No. 4,684,267, employs a fracture technique to a split bearing assembly in an effort to facilitate alignment of the split bearing upon reengagement by reducing the amount of bending necessary for reengaging the bearing components. Fetouh, however, is totally unrelated to seal assemblies and provides no insight whatsoever as to the aforementioned problems associated with seal assemblies.

Accordingly, there is a need in the art for an improved seal assembly which is capable of sealing a rotatable shaft protruding from a fluid-containing chamber in an internal combustion engine. There is also a need in the art for a method by which such an improved seal assembly can be produced.

SUMMARY OF THE INVENTION

The present invention meets the aforementioned needs in the art by providing an improved seal assembly which is capable of sealing a rotatable shaft protruding from a fluid-containing chamber in an internal combustion engine. The improved seal characteristics of the seal assembly are largely attributed to the interface between the seal cap and the main body of the seal assembly. In that regard, the seal cap includes a pair of legs each having fractured ends which are in end-to-end engagement with corresponding legs of the main body which also has fractured ends. By mating corresponding fractured ends of the respective legs, an improved seal with reduced manufacturing costs over past seal assemblies is provided. The present invention also provides a method by which such an improved seal assembly can be manufactured.

In accordance with one aspect of the invention, an improved seal assembly for an internal combustion engine is provided. The seal assembly comprises a seal carrier having a saddle-shaped main body with first and second body legs each having fractured ends and a corresponding removable saddle-shaped seal cap with first and second cap legs each having fractured ends. The first and second body legs and the first and second cap legs are correspondingly mated with one another at their respective fractured ends so as to define a sealing opening through which a rotatable shaft is mounted. In a preferred embodiment, the cap legs each include a threaded opening extending through the fractured ends thereof and into the fractured ends of the first and second body legs wherein each threaded opening is adapted to receive a correspondingly threaded bolt.

In accordance with another aspect of the invention, a method of forming a seal assembly for an internal combustion engine is provided. The method comprises the step of forming a seal carrier having a saddle-shaped main body with first and second body legs and a saddle-shaped seal cap with first and second cap legs. The first and second body legs and the first and second cap legs are integrally joined with one another so as to define an opening through which a camshaft is mounted. Further, the method includes the step of separating the seal cap from the main body by fracturing the first and second cap legs and the first and second body legs along a predetermined fracture plane extending across the opening so as to provide each of the first and second cap legs and the first and second body legs with fractured ends. The fractured ends of the first and second cap legs and corresponding fractured ends of the first and second body legs are capable of mating with one another. Additionally, the method includes the steps of securing a rotatable shaft sized to fit within the opening in the main body such that the rotatable shaft can be sealed by the seal cap, and mating the fractured ends of the first and second cap legs to corresponding fractured ends of the first and second body legs such that the rotatable shaft is substantially sealed.

Accordingly, it is an object of the present invention to provide an improved seal assembly which is capable of sealing a rotatable shaft protruding from a fluid-containing chamber in an internal combustion engine; and, it is also an object of the invention to provide a method by which such an improved seal assembly can be produced. Other objects and advantages of the invention will be apparent from the following detailed description, the accompanying drawings and the appended claims.

DETAILED DESCRIPTION OF THE PREFERRED EMBODIMENTS

Figure 1:
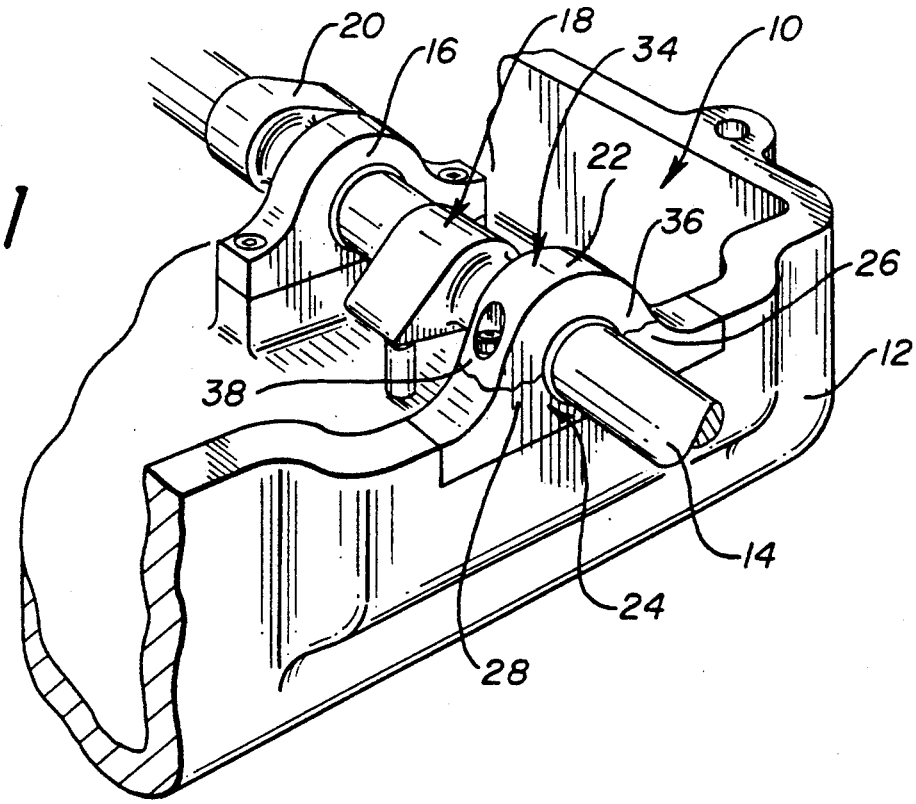
FIG. 1 is a fragmentary perspective view of the seal assembly as disposed in the head of an internal combustion engine.

Referring now to FIG. 1, a seal assembly, generally designated by reference numeral 10, is illustrated. As depicted in FIG. 1, seal assembly 10 is contained within a head 12 in an internal combustion engine having a camshaft 14 along with at least one set of split bearings 16 and corresponding cams 18 and 20 for operation of the components in the engine block (not shown). It should be understood, however, that seal assembly 10 may be employed in other areas of an internal combustion engine or other applications such as generators, transmissions, etc. having a rotatable shaft protruding from a fluid-containing internal chamber. To that end, seal assembly 10 preferably comprises a seal carrier 22 having a saddle-shaped main body 24 with a pair of body legs 26 and 28 each having fractured ends 30 and 32, respectively (best seen in FIG. 3). Further, seal carrier 22 has a corresponding removable saddle-shaped seal cap 34 with a pair of cap legs 36 and 38 each having fractured ends 40 and 42, respectively (also best seen in FIG. 3). As will be discussed more fully below, seal carrier 22 provides seal assembly 10 having an improved seal as compared to those used in the past.

Figure 2:
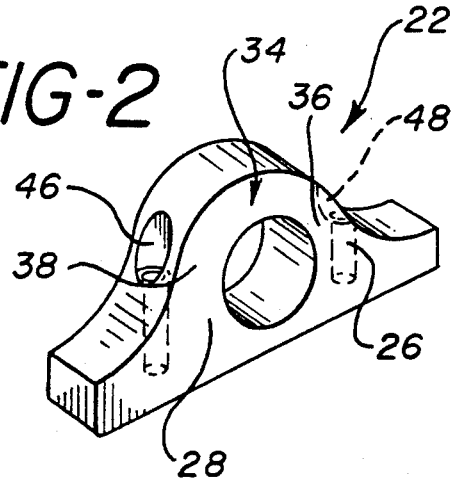
FIG. 2 is a perspective view of the seal carrier in accordance with the present invention.
Figure 3:
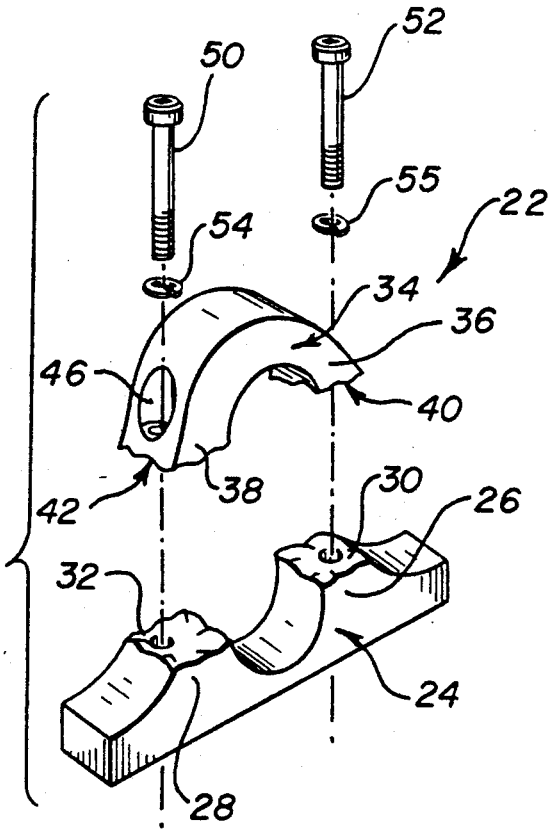
FIG. 3 is an exploded view of the seal carrier after it has been fractured in accordance with the invention.

Referring now collectively to FIGS. 2 and 3, isolated views of seal carrier 22 are illustrated to provide a better understanding of the manner in which seal assembly 10 provides an improved seal. FIG. 2 illustrates seal carrier 22 as formed originally prior to mounting within the internal combustion engine. As seen in FIG. 2, seal carrier 22 is substantially in one piece wherein body legs 26 and 28 and cap legs 36 and 38 are correspondingly joined with one another so as to define a sealing opening 44 through which camshaft 14 (FIG. 1) is mounted. FIG. 3, on the other hand, illustrates an exploded or disassembled view of seal carrier 22 which is necessary for mounting camshaft 14 in seal assembly 10. Depending upon the particular application of seal assembly 10, sealing opening 44 typically will have a diameter in a range from about 6 mm to about 12 mm. The method by which seal assembly 10 is formed is described more fully below.

As shown in FIG. 3, cap leg 38 is mated to body leg 28 by mating fractured end 42 to fractured end 32 and cap leg 36 is mated to body leg 26 by mating fractured end 40 to fractured end 30. In this manner, seal carrier 22 can be reassembled securely after mounting camshaft 14 in that fractured ends 30 and 40 and fractured ends 32 and 42, respectively, are more intimately mated together as compared to machine surfaces since each and every crevice and groove has a corresponding crevice or groove within which it can be mated. This type of mating provides an improved seal since virtually no cracks or space through which fluid from head 12 can seep are formed upon reassembly of seal carrier 22. Past seal assemblies employed seal carriers in which the legs were sawed or otherwise cut open. These prior methods led to an imperfect match of the legs upon reassembly. It was this imperfect match between past seal caps and corresponding main bodies which provided cracks or space at their respective interfaces through which fluid could leak. The present invention, on the other hand, provides a seal assembly 10 having a seal carrier 22 which eliminates such a problem.

For purposes of effectuating the mating of fractured ends 30 and 40 and fractured ends 32 and 42, respectively, it is preferable to form main body 24 and seal cap 34 of seal carrier 22 from a substantially brittle material. As used herein, a substantially brittle material is one capable of being manifested by fracture without appreciable prior plastic deformation. To that end, seal cap 34 and main body 24 are preferably made from a material selected from the group consisting of iron, steel, aluminum and alloys thereof. While such materials are preferred, those skilled in the art will appreciate that other materials which are substantially brittle, as defined herein, may be used without departing from the scope of the present invention.

Preferably, cap leg 38 includes a threaded opening 46 extending through fractured end 42 of cap leg 38 and into fractured end 32 of corresponding body leg 28. While only threaded opening 46 is easily seen in FIGS. 1-3, it is also preferable for seal carrier 22 to include a threaded opening 48 (only partially seen in FIG. 2) which extends through fractured end 40 of cap leg 36 and into fractured end 30 of body leg 26. It is also preferable for threaded opening 46 and threaded opening 48 to be adapted to receive correspondingly threaded bolts 50 and 52, respectively. As those skilled in the art will appreciate, threaded bolts 50 and 52 are used to secure seal carrier 22 to head 12 as well as to secure cap legs 36 and 38 to body legs 28 and 26, respectively. The load applied by threaded bolts 50 and 52 is sufficient to hold the entire seal assembly 10, including camshaft 14 which rotates within sealing opening 44, to head 12 as seen in FIG. 1. In that regard, a pair of washers 54 and 55, correspondingly sized with threaded bolts 50 and 52, respectively, may be used to facilitate support of such a load upon attachment of seal carrier 22 to head 12.

Figure 4:
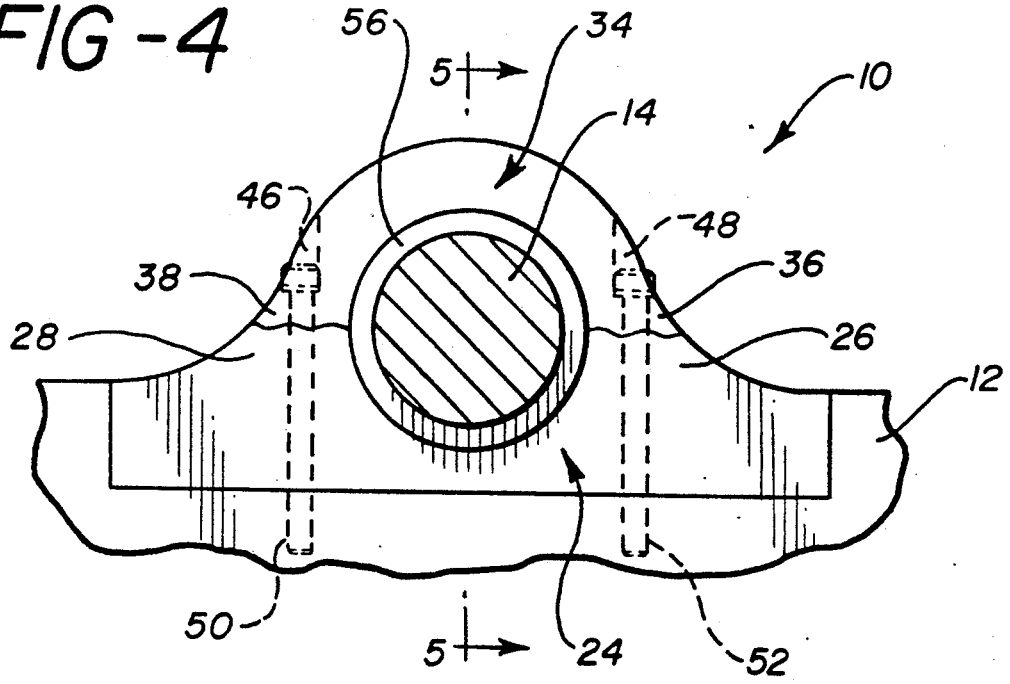
FIG. 4 is a front view of the seal assembly as shown in FIG. 1.
Figure 5:
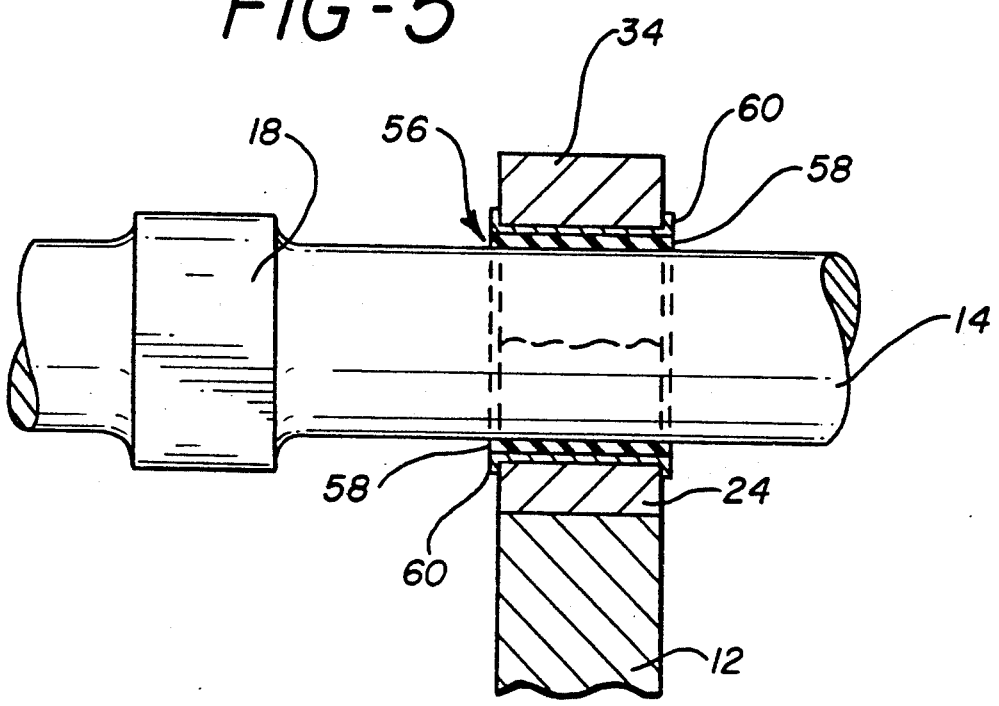
FIG. 5 is a side elevational view, partially in cross-section, of the seal assembly taken along view line 5-5 in FIG. 4.

Reference is now made collectively to FIGS. 4 and 5 which provide a better understanding of the manner in which seal assembly 10 is mounted to head 12 in FIG. 1. FIGS. 4 and 5 illustrate the presence of a radial lip seal 56 which is preferably mounted within sealing opening 44 such that radial lip seal 56 is concentric with camshaft 14. Preferably, radial lip seal 56 comprises an inner elastomeric ring 58 mounted in an outer metal ring 60 which supports elastomeric ring 58 and which attaches radial lip seal 56 within sealing opening 44. Thus, the radial lip seal is depicted collectively in FIGS. 4 and 5 by reference numeral 56 while its individual components are referenced as elastomeric ring 58 and outer metal ring 60 which are most clearly seen in FIG. 5 taken along view line 5—5 in FIG. 4. This type of radial lip seal 56 is well known in the art and is most effective for such purposes. It should be understood, however, that radial lip seals having different structural configurations may be used without departing from the scope of the invention. Additionally, those skilled in the art will appreciate that seal assembly 10 may operate adequately without the inclusion of radial lip seal 56. For example, a bushing or similar device may be substituted for radial lip seal 56 in seal assembly 10 without departing from the scope of the invention.

The present invention also provides a method by which seal assembly 10 is formed. The method of the invention comprises the initial step of forming seal carrier 22 having main body 24 with body legs 26 and 28 and seal cap 34 with cap legs 36 and 38. It is preferable for body legs 26 and 28 and cap legs 36 and 38 to be integrally joined with one another substantially as a single piece in a manner which defines sealing opening 44 through which camshaft 14 is mounted. In that regard, the preferred method comprises the step of hot forming a powdered metal alloy into seal carrier 22 substantially as a single piece. The powdered metal alloy may be an alloy of, for example, iron, steel or aluminum. By hot forming seal carrier 22 from those materials, the ultimate brittleness of seal carrier 22 is ensured. Those skilled in the art will appreciate that any optional finishing operations to which seal carrier 22 may be subjected are preferably completed at this point in preparation for subsequent processing.

Additionally, the present method contemplates the optional step of cooling seal carrier 22 to a temperature at which seal carrier 22 is substantially brittle so as to facilitate formation of fractured ends 40 and 42 in cap legs 36 and 38, respectively, as well as to facilitate formation of fractured ends 30 and 32 in body legs 26 and 28, respectively. Such a step may be necessary when less brittle materials are used. Thus, if seal carrier 22 is formed from a ductile or insufficiently brittle material, seal carrier 22 may be temporarily made brittle for processing purposes by reducing the temperature to a sufficiently low level. This can be done, for example, by soaking sealing carrier 22 in liquid nitrogen until it reaches a temperature level of −150° F. Alternatively, seal carrier 22, made from ductile or insufficiently brittle materials, may be subjected to heat treatment or selective hardening by any suitable process to embrittle the material sufficiently along the intended fracture plane to avoid excessive plastic deformation upon the separation step which is discussed more fully below.

Further, the present method includes the step of separating seal cap 34 from main body 24 by fracturing cap legs 36 and 38 and body legs 26 and 28 along a predetermined fracture plane extending across sealing opening 44 so as to provide each of cap legs 36 and 38 and body legs 26 and 28 with fractured ends 30 and 40 and 32 and 42, respectively. It should be understood that a variety of apparatus may be used to actually execute the above-referenced separating step. For example, suitable apparatus and associated techniques are disclosed in Hoag et al, U.S. Pat. No. 4,993,134, the disclosure of which is incorporated herein by reference. With respect to the aforementioned fracture plane, it should be understood that while seal carrier 22 may be conceivably fractured along any plane, it is preferably fractured along a fracture plane extending through a diameter of sealing opening 44 which is generally parallel with head 12. As discussed in detail above with respect to FIGS. 2 and 3, fractured ends 30 and 40 are correspondingly mated with one another and fractured ends 32 and 42 are also correspondingly mated with one another after camshaft 14 is mounted in sealing opening 44.

Additionally, the method includes the step of securing camshaft 14, which is sized to fit within sealing opening 44 in main body 24, such that camshaft 14 can be sealed by seal cap 34. Thereafter, fractured ends 30 and 40 and fractured ends 32 and 42, respectively, are mated such that camshaft 14 is substantially sealed. The method preferably also comprises the step of mounting radial lip seal 56, as described above, around camshaft 14 after securing camshaft 14 within sealing opening 44. In addition, the preferred method comprises the step of mounting seal carrier 22 adjacent a fluid-containing internal chamber, such as head 12, in an internal combustion engine such that seal carrier 22 prevents leaking of fluid, in this case engine oil from head 12 as shown in FIG. 1.

Furthermore, the method according to the invention preferably comprises the step of forming threaded openings 46 and 48 in cap legs 38 and 36, respectively, which extend through each of fractured ends 40 and 42 of cap legs 36 and 38, respectively. It is preferable that only those portions of threaded openings 46 and 48 which pass through seal cap 34 actually be threaded while the remaining portions which pass through main body 24 are threadless or smooth. In this way, seal carrier 22 can be bolted or otherwise secured to head 12. To that end, the preferred method also comprises the step of mounting bolts 50 and 52, correspondingly sized with threaded openings 46 and 48, in each of threaded openings 46 and 48 such that main body 24 of seal carrier 22 is bolted to head 12 of the internal combustion engine. It should be understood that this step is preferably completed after mounting camshaft 14 in sealing opening 44 so as to hold the entire seal assembly 10 together. While the preferred steps of the present method have been fully described herein, those skilled in the art will appreciate that additional steps necessary for incorporating components or, otherwise finishing seal assembly 10, may be used without departing from the scope of the invention.

Having described the invention in detail and by reference to preferred embodiments thereof, it will be apparent that modifications and variations are possible without departing from the scope of the invention which is defined in the appended claims. For example, substantially brittle materials other than those described herein may be used in forming seal assembly 10.

What is claimed is:

1. A seal assembly comprising:

a seal carrier having a saddle-shaped main body with first and second body legs each having fractured ends and a corresponding removable saddle-shaped seal cap with first and second cap legs each having fractured ends, said first and second body legs and said first and second cap legs being correspondingly mated with one another at their respective fractured ends so as to define a sealing opening accommodating a radial lip seal and through which a rotatable shaft is mounted, wherein said seal carrier is mounted adjacent an internal chamber containing a fluid in an internal combustion engine for preventing leakage of said fluid from said internal chamber.

2. The seal assembly of claim 1 wherein said seal carrier is affixed to a head in an internal combustion engine.

3. The seal assembly of claim 1 wherein said seal cap and said main body are made from a material selected from the group consisting of iron, steel, aluminum and alloys thereof.

4. The seal assembly of claim 1 wherein said fluid is engine oil.

5. The seal assembly of claim 1 wherein said first and second cap legs each include a threaded opening extending through said fractured ends thereof and into said fractured ends of said first and second body legs, each said threaded opening being adapted to receive a correspondingly threaded bolt.

6. The seal assembly of claim 1 wherein said rotatable shaft is a camshaft adapted to be used in an internal combustion engine.

7. The seal assembly of claim 1 wherein said main body and said seal cap of said seal carrier are formed from a substantially brittle material.

8. A seal assembly comprising:

a seal carrier having a saddle-shaped main body with first and second body legs each having fractured ends and a corresponding removable saddle-shaped seal cap with first and second cap legs each having fractured ends, said first and second body legs and said first and second cap legs being correspondingly mated with one another so as to define an opening through which a camshaft is mounted, said first and second cap legs each include a threaded opening extending through said fractured ends thereof and into said fractured ends of said first and second body legs such that said seal carrier can be secured to a head in an internal combustion engine with a pair of bolts correspondingly sized with said threaded opening; and a radial lip seal mounted within said opening such that said radial lip seal is concentric with said rotatable shaft, said radial lip seal comprising a metal ring within which an elastomeric ring is mounted such that said elastomeric ring contacts the outer surface of said rotatable shaft.

9. A seal assembly comprising:

a seal carrier having a saddle-shaped main body with first and second body legs each having fractured ends and a corresponding removable saddle-shaped seal cap with first and second cap legs each having fractured ends, said first and second body legs and said first and second cap legs being correspondingly mated with one another at their respective fractured ends so as to define a sealing opening through which a rotatable shaft is mounted; and a radial lip seal mounted within said opening such that said radial lip seal is concentric with said rotatable shaft.

10. A method of forming a seal assembly comprising the steps of:

forming a seal carrier having a saddle-shaped main body with first and second body legs and a saddle-shaped seal cap with first and second cap legs, said first and second body legs and said first and second cap legs being integrally joined with one another so as to define an opening through which a camshaft is mounted;

separating said seal cap from said main body by fracturing said first and second cap legs and said first and second body legs along a predetermined fracture plane extending across said opening so as to provide each of said first and second cap legs and said first and second body legs with fractured ends, said fractured ends of said first and second cap legs and corresponding said fractured ends of said first and second body legs being capable of mating with one another;

securing a rotatable shaft sized to fit within said opening in said main body such that said rotatable shaft can be sealed by said seal cap;

mating said fractured ends of said first and second cap legs to corresponding said fractured ends of said first and second body legs such that said rotatable shaft is substantially sealed; and mounting a radial lip seal around said rotatable shaft after securing said rotatable shaft within said opening.

11. A method of forming a seal assembly comprising the steps of:

forming a seal carrier having a saddle-shaped main body with first and second body legs and a saddle-shaped seal cap with first and second cap legs, said first and second body legs and said first and second cap legs being integrally joined with one another so as to define an opening through which a camshaft is mounted;

mounting a radial lip seal in said opening;

separating said seal cap from said main body by fracturing said first and second cap legs and said first and second body legs along a predetermined fracture plane extending across said opening so as to provide each of said first and second cap legs and said first and second body legs with fractured ends, said fractured ends of said first and second cap legs and corresponding said fractured ends of said first and second body legs being capable of mating with one another;

securing a rotatable shaft sized to fit within said opening in said main body such that said rotatable shaft can be sealed by said seal cap;

mating said fractured ends of said first and second cap legs to corresponding said fractured ends of said first and second body legs such that said rotatable shaft is substantially sealed, and mounting said seal carrier adjacent an internal chamber containing a fluid in an internal combustion engine such that said seal carrier prevents leakage of said fluid from said internal chamber.

12. The method of claim 11 wherein said forming step comprises the step of hot forming a powdered metal alloy into said seal carrier.

13. The method of claim 11 further comprising the step of cooling said seal carrier to a temperature at which said seal carrier is substantially brittle so as to facilitate formation of said fractured ends in each of said first and second cap legs and in each of said first and second body legs.

14. The method of claim 11 further comprising the step of forming a threaded opening in each of said first and second cap legs which extends through each of said fractured ends of said first and second cap legs and into corresponding said fractured ends of said first and second body legs such that said threaded opening penetrates through said main body.

15. The method of claim 14 further comprising the step of mounting a pair of bolts correspondingly sized with said threaded opening in each said threaded opening such that said main body of said seal carrier is secured in an internal combustion engine.

16. The method of claim 11 wherein said rotatable shaft is a camshaft adapted to be used in an internal combustion engine.

17. The method of claim 11 wherein said seal cap and said main body are made from a material selected from the group consisting of iron, steel, aluminum and alloys thereof.

18. The method of claim 11 further comprising the step of securing said seal carrier to a head in an internal combustion engine.

19. A method of using a seal assembly comprising the steps of:

providing a seal carrier having a saddle-shaped main body with first and second body legs each having fractured ends and a corresponding removable saddle-shaped seal cap with first and second cap legs each having fractured ends, said first and second body legs and said first and second cap legs being correspondingly mated with one another at their respective fractured ends so as to define a sealing opening accommodating a radial lip seal and through which a rotatable shaft is mounted; and mounting said seal carrier adjacent an internal chamber containing a fluid in an internal combustion engine such that said seal carrier prevents leaking of said fluid from said internal chamber.

* * * * *